US009155958B2

(12) United States Patent
Zylkin

(10) Patent No.: US 9,155,958 B2
(45) Date of Patent: Oct. 13, 2015

(54) DIE FOR USE IN GAME PLAY

(76) Inventor: Jack Zylkin, Philadelphia, PA (US)

( * ) Notice: Subject to any disclaimer, the term of this patent is extended or adjusted under 35 U.S.C. 154(b) by 619 days.

(21) Appl. No.: 13/409,599

(22) Filed: Mar. 1, 2012

(65) Prior Publication Data

US 2012/0223477 A1 Sep. 6, 2012

Related U.S. Application Data

(60) Provisional application No. 61/448,661, filed on Mar. 3, 2011.

(51) Int. Cl.
*A63F 9/04* (2006.01)
*A63F 9/24* (2006.01)

(52) U.S. Cl.
CPC ..... *A63F 9/0468* (2013.01); *A63F 2009/2454* (2013.01)

(58) Field of Classification Search
CPC ..... A63F 9/04
USPC ..... 273/146
See application file for complete search history.

(56) References Cited

U.S. PATENT DOCUMENTS

| | | | | |
|---|---|---|---|---|
| 1,578,554 | A * | 3/1926 | Seligman | 273/153 R |
| 2,646,986 | A * | 7/1953 | Mentzer | 273/121 A |
| 2,802,669 | A * | 8/1957 | Szwartz | 273/145 R |
| 3,357,703 | A | 12/1967 | Hurley | |
| 3,459,427 | A * | 8/1969 | Rhodes | 463/22 |
| 4,034,988 | A * | 7/1977 | Goldner et al. | 463/22 |
| 4,124,881 | A * | 11/1978 | Haber et al. | 362/253 |
| 4,181,304 | A * | 1/1980 | Haber | 273/146 |
| 4,188,779 | A | 2/1980 | Fatton | |
| 4,506,890 | A * | 3/1985 | Murry | 463/22 |
| 4,641,840 | A | 2/1987 | Larson | |
| 4,858,931 | A | 8/1989 | McKechmie | |
| D310,110 | S | 8/1990 | Dawson | |
| 5,031,914 | A * | 7/1991 | Rosenthal | 463/22 |
| 5,069,458 | A * | 12/1991 | Washington | 273/238 |
| 6,019,371 | A * | 2/2000 | Mantis | 273/256 |
| 6,042,487 | A * | 3/2000 | Schrimmer et al. | 473/353 |
| 6,220,594 | B1 | 4/2001 | Peng | |
| 6,257,995 | B1 * | 7/2001 | Schrimmer et al. | 473/353 |
| 6,331,145 | B1 * | 12/2001 | Sity et al. | 463/22 |
| 6,588,748 | B2 * | 7/2003 | Solow et al. | 273/146 |
| 6,685,353 | B2 * | 2/2004 | Arroyo | 368/276 |
| 6,877,887 | B2 * | 4/2005 | Lin | 362/487 |
| 7,017,905 | B2 * | 3/2006 | Lindsey | 273/146 |
| 7,211,959 | B1 * | 5/2007 | Chou | 315/149 |
| 7,334,791 | B2 | 2/2008 | Lindsey et al. | |

(Continued)

OTHER PUBLICATIONS

Critical Hit D20 Die, http:/www.thinkgeek.com/geektoys/games/deaa, 2011.

(Continued)

*Primary Examiner* — Michael Dennis
*Assistant Examiner* — Dolores Collins
(74) *Attorney, Agent, or Firm* — Mendelsohn, Drucker & Dunleavy, P.C.

(57) ABSTRACT

A die having at least two variable qualities that convey information for use in game play, wherein the variable qualities randomly change independently of one another upon rolling the die. Therefore, multiple independent random outcomes are produced each roll of the die. Preferably, at least one of the variable qualities is the color of the die such that the die changes color in response to sensor-detected movement of the die.

14 Claims, 10 Drawing Sheets

(56) References Cited

U.S. PATENT DOCUMENTS

| | | | | |
|---|---|---|---|---|
| 8,142,283 | B2 * | 3/2012 | Lutnick et al. | 463/29 |
| 8,235,804 | B2 * | 8/2012 | Gagner et al. | 463/25 |
| 8,480,471 | B2 * | 7/2013 | Lutnick et al. | 463/17 |
| 8,662,995 | B2 * | 3/2014 | Hawkins et al. | 463/22 |
| 8,677,307 | B1 * | 3/2014 | Jarosz et al. | 716/139 |
| 8,678,925 | B1 * | 3/2014 | Kahn et al. | 463/37 |
| 2005/0164778 | A1 * | 7/2005 | Cooney | 463/22 |
| 2006/0017225 | A1 | 1/2006 | Nicely | |
| 2008/0268942 | A1 * | 10/2008 | DeRuyter | 463/22 |
| 2009/0210101 | A1 * | 8/2009 | Hawkins et al. | 700/297 |
| 2011/0237367 | A1 * | 9/2011 | Kodama et al. | 473/570 |
| 2013/0178275 | A1 * | 7/2013 | Hawkins et al. | 463/22 |

OTHER PUBLICATIONS

Soft Assorted Bouncy Dice, http://www.flashingblinkylights.com, 2011.

Zygote Ball, http://tangibleinteraction.com/gallery/zygote, 2011.

LED Color Changing Night Light, htpp://www.meritline.com, 2011.

* cited by examiner

FIGURE 8

YELLOW
RED
BLUE
GREEN
YELLOW
WHITE
MAGENTA
YELLOW
BLUE
RED
GREEN
YELLOW
MAGENTA
GREEN
WHITE
BLUE
MAGENTA
GREEN
WHITE
RED
GREEN
WHITE
BLUE
RED
MAGENTA
YELLOW
RED
WHITE
BLUE
YELLOW
RED
BLUE
MAGENTA
BLUE
MAGENTA
WHITE
GREEN
YELLOW
GREEN
RED
WHITE
MAGENTA

| | | | | | | | | | | | | | | |
|---|---|---|---|---|---|---|---|---|---|---|---|---|---|---|
| R | B | G | Y | M | W | M | W | G | R | B | M | G | R | W |
| G | Y | M | B | W | R | Y | W | B | M | G | W | Y | R | M |
| B | W | Y | R | M | W | G | B | G | Y | G | Y | W | M | G |
| M | W | B | M | G | Y | W | R | M | R | B | G | Y | M | W |
| W | B | M | G | W | Y | B | M | R | G | B | Y | W | Y | B |
| W | R | G | M | B | R | G | W | M | W | M | Y | G | B | R |
| B | Y | M | R | G | M | Y | G | B | W | R | B | W | R | M |
| M | R | Y | W | G | B | M | | Y | R | W | B | M | Y | G |
| G | M | W | Y | G | Y | B | G | R | Y | W | G | M | B | W |
| R | B | G | Y | M | W | M | W | G | R | B | M | G | R | Y |
| Y | M | R | G | M | Y | R | B | M | Y | R | B | W | Y | W |
| W | R | B | M | Y | G | Y | W | R | G | W | B | M | R | B |
| M | W | M | G | M | R | M | B | Y | W | G | R | B | M | R |
| G | W | Y | R | M | B | Y | R | G | B | M | W | R | B | Y |
| B | G | R | G | W | B | M | W | G | M | B | R | Y | G | W |

DIE FOR USE IN GAME PLAY

This application is a non-provisional of and claims benefit of priority to U.S. Provisional Application No. 61/448,661, filed Mar. 3, 2011, the entire disclosure of which is hereby incorporated by reference as if set forth fully herein.

BACKGROUND OF THE INVENTION

1. Field of the Invention

The present invention is in the technical field of toys and games. More particularly, the present invention relates to a die having at least two variable qualities that randomly change independently of one another upon rolling the die, thereby yielding two randomized outcomes conveying information useful in game play with each roll of the die. Preferably at least one of the variable qualities is the color of the die such that the die changes color in response to sensor-detected acceleration of the die.

2. Description of the Related Technology

Conventional playing dice generally have a cubic structure with faces numbered one through six. The pursuit of novel and entertaining ways to enhance game play has led to the development of dice that incorporate electronic components. For example, some dice are internally illuminated or have electronic displays on their faces.

U.S. Pat. Nos. 4,181,304 and 4,124,881 disclose dice that containing a plurality of light emitting diodes (LEDs) controlled by a gravity switch in such a way that only the uppermost face of the die is illuminated after each roll. U.S. Patent Application Publication No. 2008/0268942 accomplishes a similar feat with a mechanical means for orienting the light. Despite the added illumination, such die only have one quality that can be interpreted by a player as a variable quality, namely which of the distinctly numbered die faces is upwardly oriented after rolling the die. Because the illumination of the uppermost face of the die never changes with each roll of the die, it does not contribute any meaning to the result of the die roll for purposes of influencing game play. Notably, the illumination means does not change the color of the die or change the state of any other qualities of the die in a way that influences game play. These dice therefore have only one degree of freedom.

The Critical Hit LED D20 Die, a twenty-sided die that produces illumination only when the face of the die bearing the number 20 is facing up, is similar to the aforementioned patents. Because the behavior of the illumination is dependent only upon the numerical result of any given roll, it is entirely predictable and does not add any further meaning to the information already displayed by the die. Consequently, it does not influence game play. Similarly to the previously discussed dice, the illumination means does not change the color of the die or change the state of any other qualities of the die in a way to influence game play. Therefore the die has only one degree of freedom.

The Soft Assorted Dice by FlashingBlinkyLights are dice-shaped novelty toys embedded with one or more colored LEDs, which flash in response to the movement of the toy. The LEDs flash on and off in a pre-set repeating pattern. As the displayed flash pattern is always the same each time the die is thrown, the flash pattern in itself cannot be interpreted by the player as a variable quality useful in directing game play. Therefore the only random outcome that results from rolling such a die is the number shown on the uppermost die face.

U.S. Pat. No. 4,641,840 describes a playing die equipped on each face with a seven-segment electronic display, similar to that found on many digital clocks. After each roll, a motion-sensing switch triggers an electronic number generator, which assigns a number to be shown on each face of the die. Similarly, U.S. Pat. Nos. 7,017,905 and 7,334,791 disclose dice with flashing LEDs arranged on each die face in the form of a number. These dice, however, are effectively no different than a conventional six-sided die in that it only conveys a single random numerical variable between one and six, and therefore only displays information consistent with a standard die as a result of each roll. They do not have two or more independently changing variable qualities that produce random outcomes for influencing game play.

SUMMARY OF THE INVENTION

The invention pertains to a die comprising variable qualities that convey randomized information for use in game play. In a first aspect, the invention is directed to a die including at least two variable qualities for conveying information for use in game play, wherein each of the at least two variable qualities is capable of randomly changing states independently of one another in response to rolling of the die in such a way that each variable quality yields a random outcome, wherein a first of the at least two variable qualities is a color of the die and wherein the color of the die randomly changes in response to the rolling of the die.

In a second aspect, the invention pertains to a die including a power source, a light source for changing the color of the die, a microcontroller operatively associated with said light source and an accelerometer operatively associated with said microcontroller. The color displayed by the light source changes in response to every detected acceleration of the die detected by the accelerometer, wherein the color displayed by the die conveys information for use in game play.

In a third aspect, the invention is directed to a method for playing a game, wherein the method involves rolling a die to direct game play, wherein the die includes at least two variable qualities for conveying information for use in game play, wherein each of the at least two variable qualities is capable of randomly changing states independently of one another in response to rolling of the die in such a way that each variable quality produces a random outcome, wherein a first of the at least two variable qualities is a color of the die and wherein the color of the die randomly changes in response to the rolling of the die.

BRIEF DESCRIPTION OF THE DRAWINGS

FIG. 2(*b*) is a perspective view of the die body of FIG. 1 with the lid mounted to the base.

FIG. 8 is a random sequence of colors displayed by the light source.

DETAILED DESCRIPTION OF THE PREFERRED EMBODIMENT(S)

Figure 1:
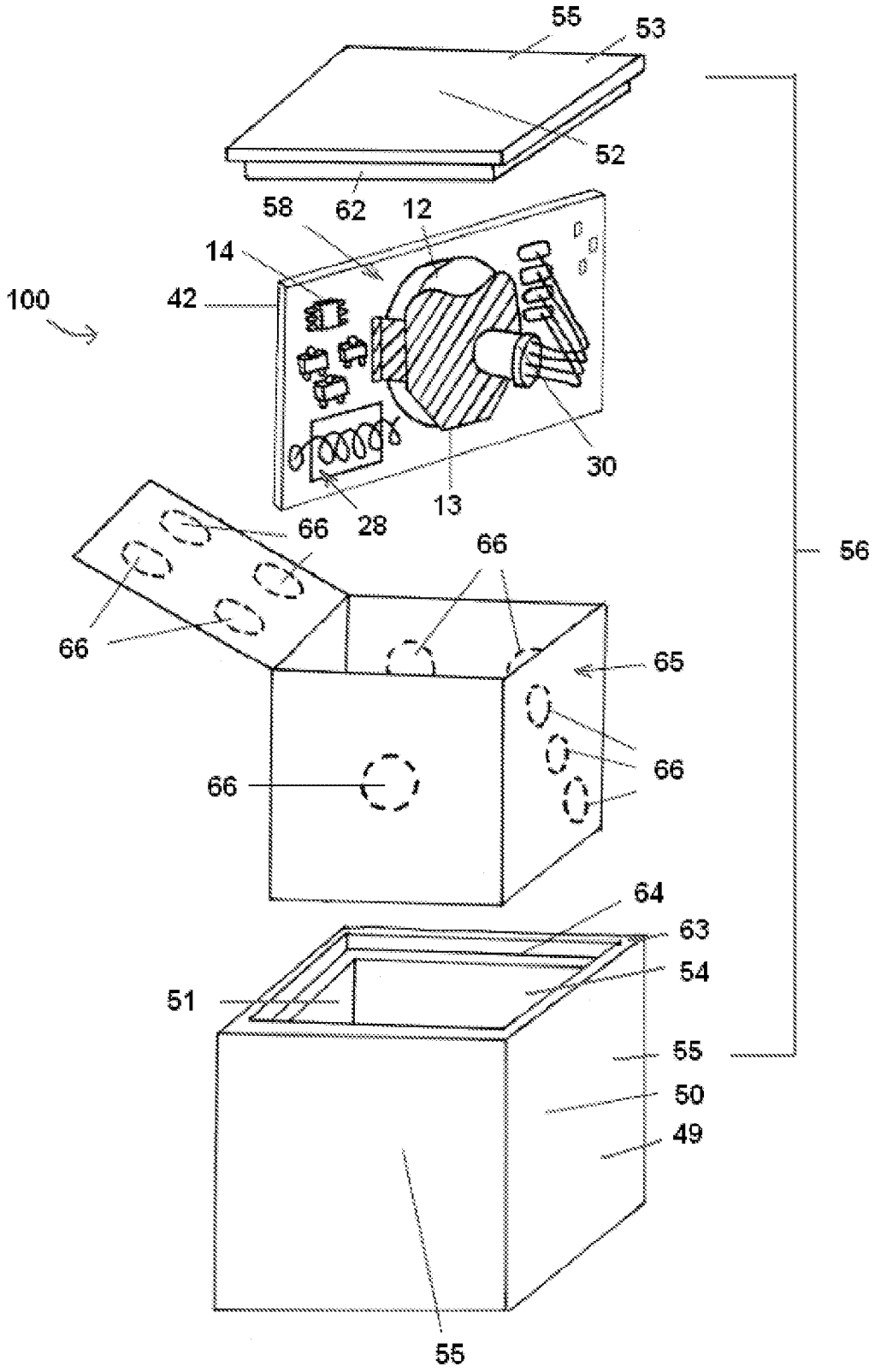
FIG. 1 is an exploded view of an exemplary die.

For illustrative purposes, the principles of the present invention are described by referencing various exemplary embodiments. Although certain embodiments of the invention are specifically described herein, one of ordinary skill in the art will readily recognize that the same principles are equally applicable to, and can be employed in other systems and methods. Before explaining the disclosed embodiments of the present invention in detail, it is to be understood that the invention is not limited in its application to the details of any particular embodiment shown. Additionally, the terminology used herein is for the purpose of description and not of limitation. Furthermore, although certain methods are described with reference to steps that are presented herein in a certain order, in many instances, these steps may be performed in any order as may be appreciated by one skilled in the art; the novel method is therefore not limited to the particular arrangement of steps disclosed herein.

It must be noted that as used herein and in the appended claims, the singular forms "a", "an", and "the" include plural references unless the context clearly dictates otherwise. Furthermore, the terms "a" (or "an"), "one or more" and "at least one" can be used interchangeably herein. The terms "comprising", "including", "having" and "constructed from" can also be used interchangeably.

For the purposes of the present invention a "variable quality" is any aspect of a die having a changeable state, perceivable by a user and disclosing information for directing game play. Preferably, variable quality refers to a feature of the die that functions as a distinct mode of communicating information through its changing state to direct game play. For example, the orientation of a die having distinctly indexed faces, specifically which indexed face of the die is facing up after rolling the die, is a variable quality of the die; therefore, a die having six distinctly indexed faces has six different possible states of orientation, of which the resulting state of orientation changes with and is dependent upon the roll of the die. Other exemplary variable qualities may include colors emitted by an internal light source of the die, light intensities emitted by an internal light source of the die and flashing patterns emitted by an internal light source of the die. A variable quality may have a finite number of discrete changeable states, such as the number of distinctly indexed faces capable of being positioned in an upward facing orientation, or a continuous range of states, such as the shades of color between red and orange or a range of light intensities. Preferably, the variable quality randomly changes states in a way that is unpredictable to an observer and may include truly random as well as pseudo-random state changes.

"Random process" as used herein is any method and/or mechanism for inducing a variable quality to change states and produce a random resulting state. During the random process, the variable quality may assume a plurality of intermediate states over time before reaching the resulting state, e.g. a steady, unchanging state. For example, the act of throwing a die having distinctly indexed faces, which induces a change in the orientation of the die, i.e. a variable quality of the die, is a random process that produces a random resulting state, i.e. the orientation of the die once the die has come to a steady state of rest. Other exemplary random processes may include a microcontroller program that randomly or pseudo-randomly selects a color, light intensity or flashing pattern emitted by an internal light source of a die using a pseudo-random algorithm, as well as the vibration of a spring that activates a motion sensor of a die, in turn inducing a change in the state of a variable quality of the die a random number of times.

As used herein, a "random outcome" or "randomized outcome" refers to a resulting state of a single variable quality of the die after being subjected to a random process and thereafter having reached a steady, unchanging state. For example, when a die having distinctly indexed faces is rolled and the die face labeled "2" lands face up, the variable quality, i.e. the orientation of the indexed die, changes as a result of being subject to the random process of rolling the die, and the random outcome is the specific orientation of the indexed die such that the uppermost die face is labeled number 2.

For purposes of the present invention, "degrees of freedom" refers to the number, n, of independent variable qualities affecting the range of states in which a die can exist for conveying information to direct game play. Preferably, degrees of freedom refers to the number of variable qualities of a die that change states randomly and independently in response to rolling the die.

The present invention is directed to a die possessing at least two uncorrelated, variable qualities that change their respective states in a random fashion independently of one another in response to the rolling of the die. The invention is predicated upon the importance of designing a die, having at least two degrees of freedom, that yields multiple randomized outcomes that independently change with each roll of the die to provide information for use in directing game play.

In an exemplary embodiment, the orientation of distinctly indexed faces of the die is a first variable quality of the die, and the color of the die, displayed by an internal light source, is a second variable quality of the die. Each time the die is rolled, it randomly reorients so as to achieve a random orientation outcome perceivable by a user, i.e. a randomly selected uppermost distinctly indexed die face. Furthermore, during each roll, the color of the die changes in response to a sensor detected motion of the die, thereby achieving a random color outcome. These random outcomes are achieved when the die is subject to random processes that induce the variable qualities of the die to randomly change states. Preferably, two or more separately acting independent random processes occur each time the die is rolled. For example, the reorientation of the die while being rolled is a random process, the random outcome of which is embodied by a resulting uppermost die face, displaying distinct indicia conveying information for use in game play, once the die has settled. The triggering of a motion detection sensor, which induces one or more changes in the color of the die each time it is triggered by sudden die movement, is another random process, statistically independent from the reorientation of the distinctly indexed die faces. A microcontroller executing a pseudo-random algorithm to calculate a new state for the displayed color is also a random process, one which operates independently of both the reorientation of the indexed die and the process of triggering the motion detection sensor. The die may also include one or more additional variable qualities, such as brightness and/or flashing pattern, conveyed by the internal light source.

Referring now to the drawings, wherein like reference numerals designate corresponding structures throughout the drawings, and referring in particular the exemplary embodiment shown in FIG. 1, die 100 includes a body 56 having multiple faces 55 displaying distinct indicia 66. The orientation of indexed die 100 is a variable quality of die 100 that randomly changes upon rolling die 100. As shown, body 56 further has an internal cavity 54 defined by faces 55 and containing one or more light sources 30 operatively associated with a microcontroller 14 and an accelerometer 28 for changing at least the color displayed by light source 30. Optionally, the brightness and/or flashing pattern displayed by light source 30 may also be changed. These changes in the variable qualities of color, brightness, flashing pattern or combinations thereof in response to detected movement of die 100 are visible through at least a portion of die 100 and establish at least one other discernable random outcome for use in directing game play after each roll. In an exemplary embodiment, body 56 is constructed as a transparent or translucent housing that allows for the simultaneous display of one or more indicia 66 and one or more colors, wherein light source 30 and at least a portion of body 56 changes color randomly in response to movement of die 100. Thus, with each roll, as the die 100 experiences a prolonged period of random movement, die 100 not only shuffles and re-orients its faces 55 several times before landing to display a specific uppermost die face 53, but also changes through a plurality of intermediate color states before the die settles 100. Once the rolled die comes to a state of rest, the color generated by light source 30 at that time is then sustained indefinitely, or at least until the device is powered down, enters a sleep state, or is moved again. Preferably, the color so displayed by light source 30 is sustained for a period of time longer than any single intermediate color is displayed by die 100 when it is in motion, i.e. during the period when is being rolled). Users may refer to this sustained color, in addition to the indicia 66 on the uppermost face 53 of die 100, to direct game play.

In the exemplary embodiment of FIG. 1, die body 56 is a hollow shell having a plurality of faces 55 that define an internal cavity 54 for containing one or more electronic components of die 100. Die faces 55 further define the exterior surface of die 100. In this embodiment, die 100 has six faces forming a cube. Alternatively, die 100 may include more or fewer faces 55, as desired, to form a die 100 having other geometric configurations.

Figure 2A:
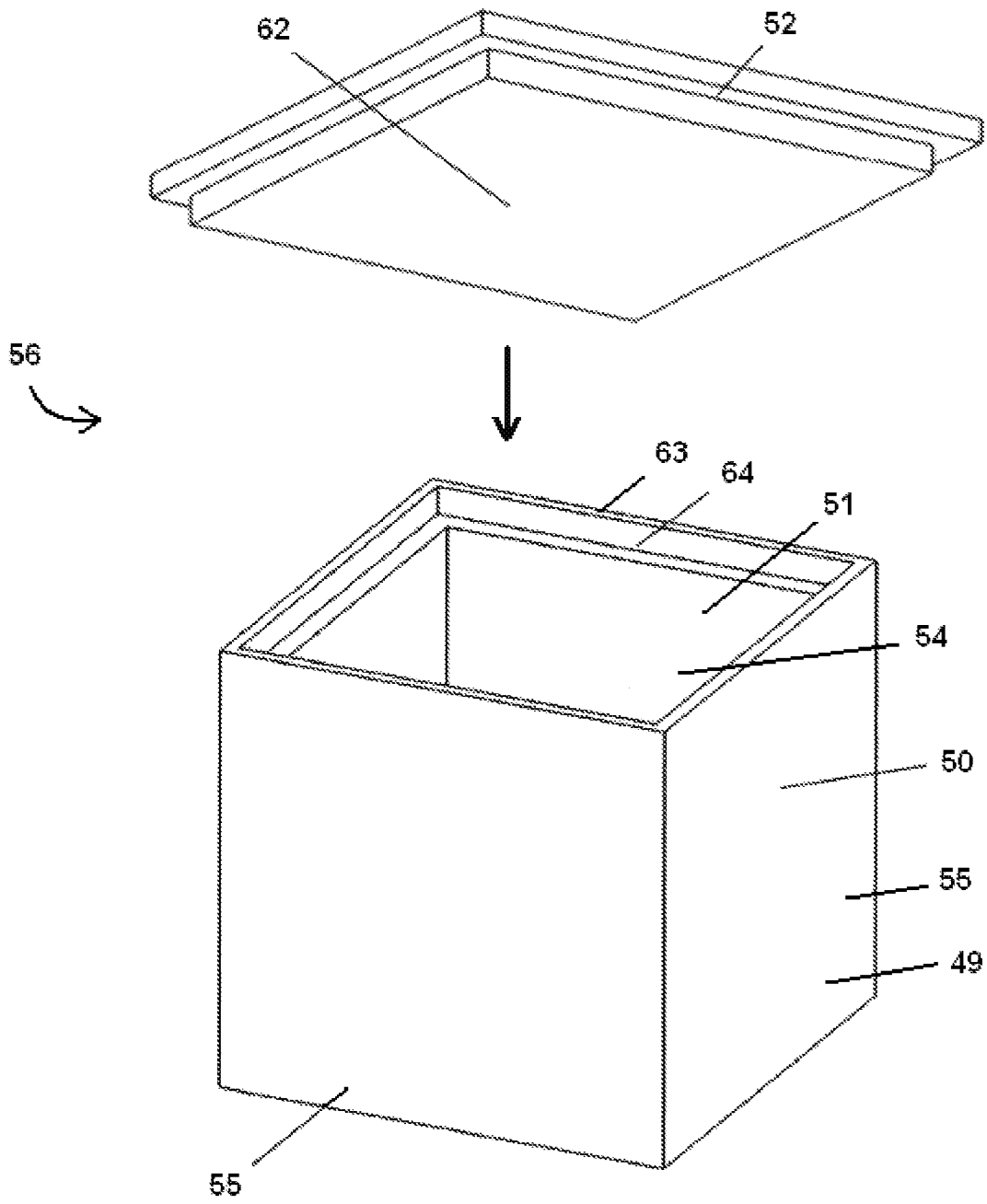
FIG. 2(*a*) is an exploded view of the die body assembly of FIG. 1, including a lid removably coupled to a base.
Figure 2B:
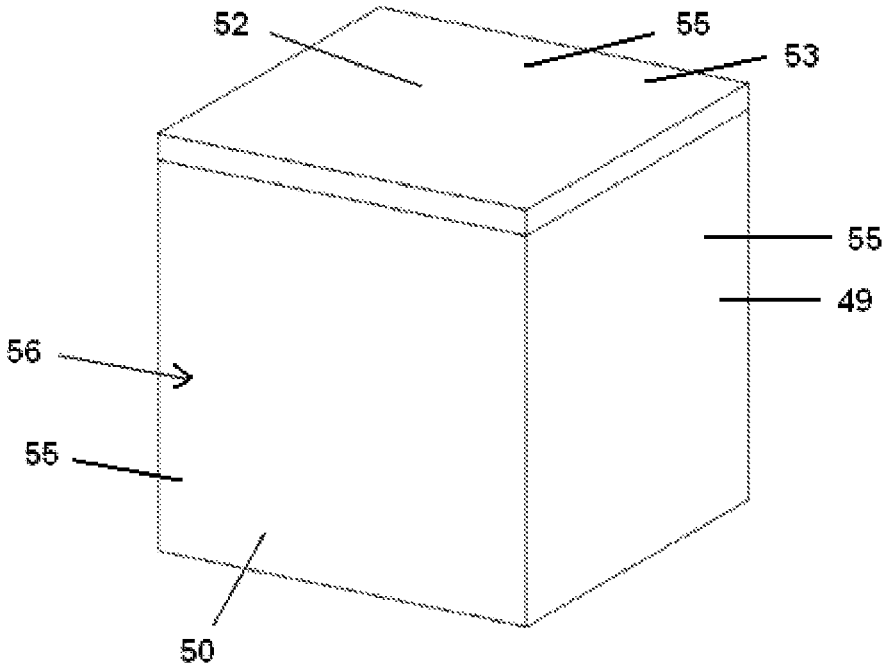

As shown in FIG. 2(*a*), die body 56 may be an assembly constructed from a base 50 and corresponding lid 52. Base 50, formed from one or more die faces 55, is configured as a container for housing the electronic components of die 100. Lid 52, formed from one or more die faces 55, may be removably attached to base 50 to form a sealed and continuous die body 56. As shown in FIG. 2(*a*), base 50 and lid 52 each have a mating feature, namely a respective recessed ledge 64 and corresponding lip 62, for removably securing lid 52 to base 50. Mating lip 62 and recessed ledge 64 are aligned, sized and shaped to tightly and removably interlock with one another. FIG. 2(*b*) shows base 50 and lid 52 friction fitted together wherein lip 62 is received by and seated on an upper surface of recessed ledge 64, such that a lower surface 26 of lid 52 adjoining lip 62 contacts and is pressed against an upper edge 63 of base 50. The friction between these mating features enables lid 52 and base 50 to remain secured to each other when die 100 is rolled, tossed, thrown or shaken during game play. Upon applying sufficient force, a user may separate lid 52 from base 50 in order to replace or repair the electronic components within cavity 54. For example, lid 52 may be detached from base 50 in order to change the batteries supplying power to light source 30, microcontroller 14 and/or accelerometer 28 of die 100.

Die body 56 may have a durable, rigid structure constructed from a material that allows for transmission of light therethrough. Preferably, the entirety of die body 56 or one or more select faces 55 thereof are translucent or transparent. In an exemplary embodiment, the material forming die body 56 is translucent, creating the impression that hollow die 100 is a solid object. Exemplary materials for forming die body 56 include plastics, such as polypropylene, which can be made durable, rigid, and translucent. It is also envisioned that die body 56 may potentially be constructed from one or more sheets of folded paper or card stock that transmits light. In some circumstances, opaque materials, such as metal or wood, may also be suitable provided they are sufficiently perforated to permit the visible transmission of light.

In addition to transmitting light, the die faces 55 further display distinctive indicia 66, such as numbers, letters or other symbols. Placement of distinct indicia 66 on die faces 55 enable the change in orientation of the die to be perceived by a user and conveys information useful in game play. This arrangement of distinct indicia 66 on different die faces 55 can be used to convey information for game play when the variable quality of die orientation is subject to the random process of rolling die 100, thereby producing a random outcome, e.g. a randomly selected, distinctly indexed, upward facing die face. The orientation of the indexed die faces 55, specifically which of the indexed faces 55 is facing up, randomly changes as the die faces 55 are repositioned during a roll of the die 100. The random process of rolling die 100 therefore produces a random die orientation outcome with each roll.

Figure 3:
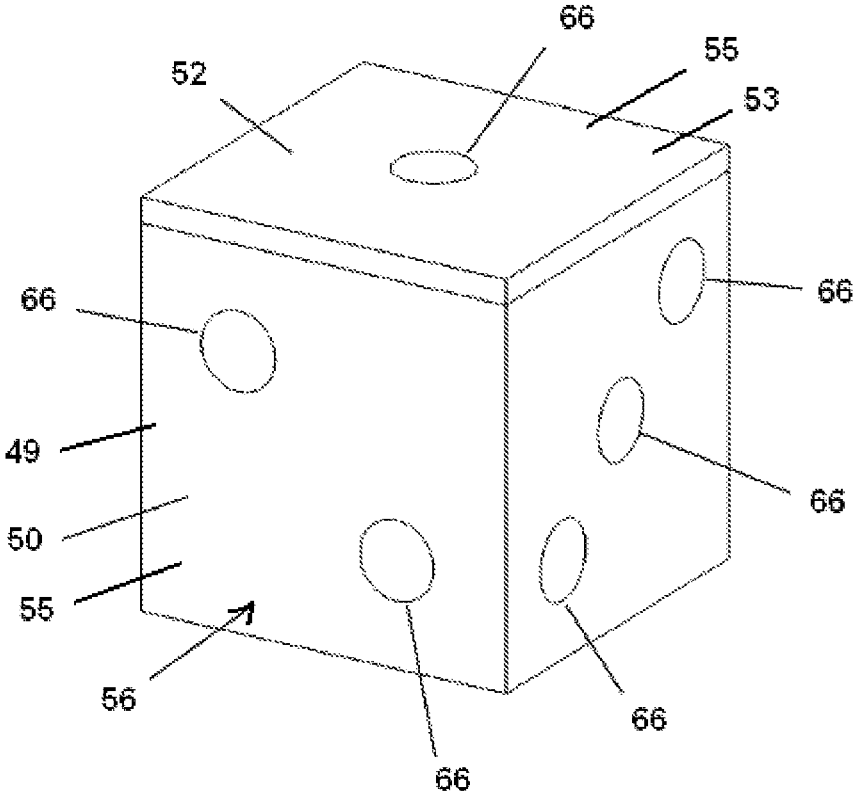
FIG. 3 is a perspective view of another die having indicia marked on an exterior surface of the die body.

Indicia 66 may be directly imprinted or otherwise marked on the exterior surfaces 49 of faces 55, as on traditional playing dice, as shown in FIG. 3. Alternatively, indicia 66 may be formed by a masking element that is adhesively attached to or otherwise operatively associated with body 56 to enable the display of indicia 66 on one or more die faces 55. For example, in one embodiment, a mask having die cut indicia 66 may be adhesively attached to an interior or exterior surface 49 of die faces 55. Die cut indicia 66 permit the selective transmission of light for displaying indicia 66 on die faces 55.

In the embodiment of FIG. 1, die 100 includes an inner die shell 65 made from a masking material. Select portions of the mask block or impede the transmission of light while other portions permit light transmission. For example, in one embodiment, the mask is constructed from an opaque material having die cut indicia 66 that permit the projection of indicia 66 onto die faces 55 of die body 56 whenever a light source is placed adjacent to the mask. Indicia 66 appear as illuminated shapes against a darker background. In another embodiment, indicia 66 are formed from a substantially opaque material in contrast to adjoining translucent or transparent portions of the mask; when positioned adjacent to a light source 30, indicia 66 appear on the faces 66 as darkened shadows against an illuminated background. Exemplary masking materials may include thin, easily folded, synthetic opaque papers, such as Yupo®.

Figure 4:
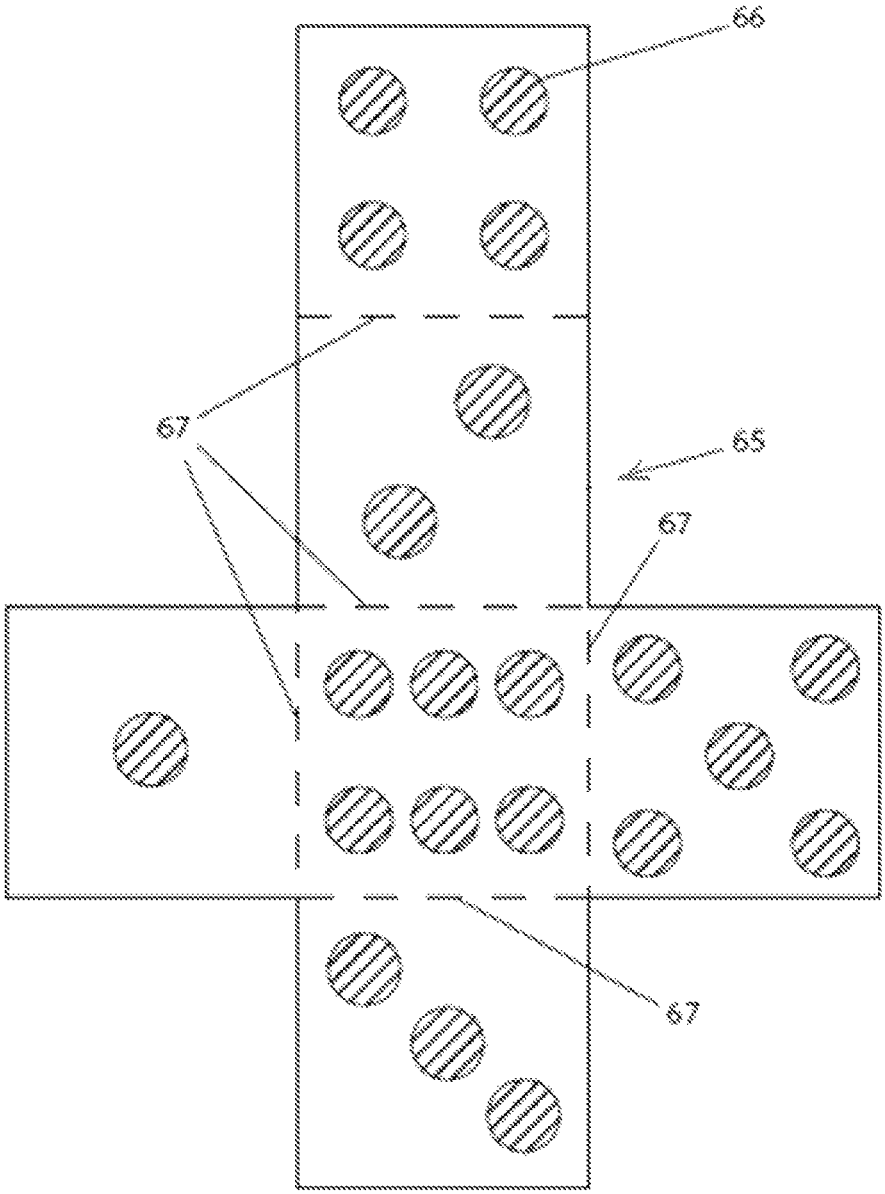
FIG. 4 is a perspective view of the inner die shell of FIG. 1 in an unfolded orientation and showing a plurality of distinct numerical indicia formed on its walls.

FIG. 4 shows inner die shell 65 before it is folded along lines 67 to form the box structure shown in FIG. 1. When folded, inner die shell 65 preferably has a shape conformal to the inner surface of an outer die shell formed by die body 56. Positioned within die body 56, the walls of inner die shell 65 preferably conform to and are proximate to an interior surface 51 of die faces 55 in such a way that inner die shell 65 snugly fits inside die body 56. The resulting die 100 therefore has two layers: a translucent exterior die body 56 and an inner die shell 65 having selectively opaque regions for displaying indicia 66 on die faces 55. The portion of the masking material defining the positive or negative space forming indicia 66 selectively block or diffract light from the light source 30 to produce shadows perceptible on the exterior surface 49 of the die body 56 that form indicia 66 on the exterior surface of die body 56 in silhouette.

As shown in FIG. 1, an electronic assembly 58 for changing the color, light emission intensity, coded flashing pattern or combinations thereof displayed by at least a portion of die 100 is contained within the internal cavity 54 of die body 56. The electronic assembly 58 includes one or more light sources 30, a microcontroller 14 and an accelerometer 28 mounted on a printed circuit board 42 and operatively associated with one another for changing the color, brightness, flashing pattern or combinations thereof displayed by light source 30 in response to the detected motion of die 100. The color, brightness, and/or flashing pattern of light source 30 constitutes at least one other variable quality of die 100, which is changed to a new random state, by one or more random processes, specifically by the detection of random motion by accelerometer 28 and by the random color, brightness and/or flashing pattern selection determined by microcontroller 14.

Figure 5:
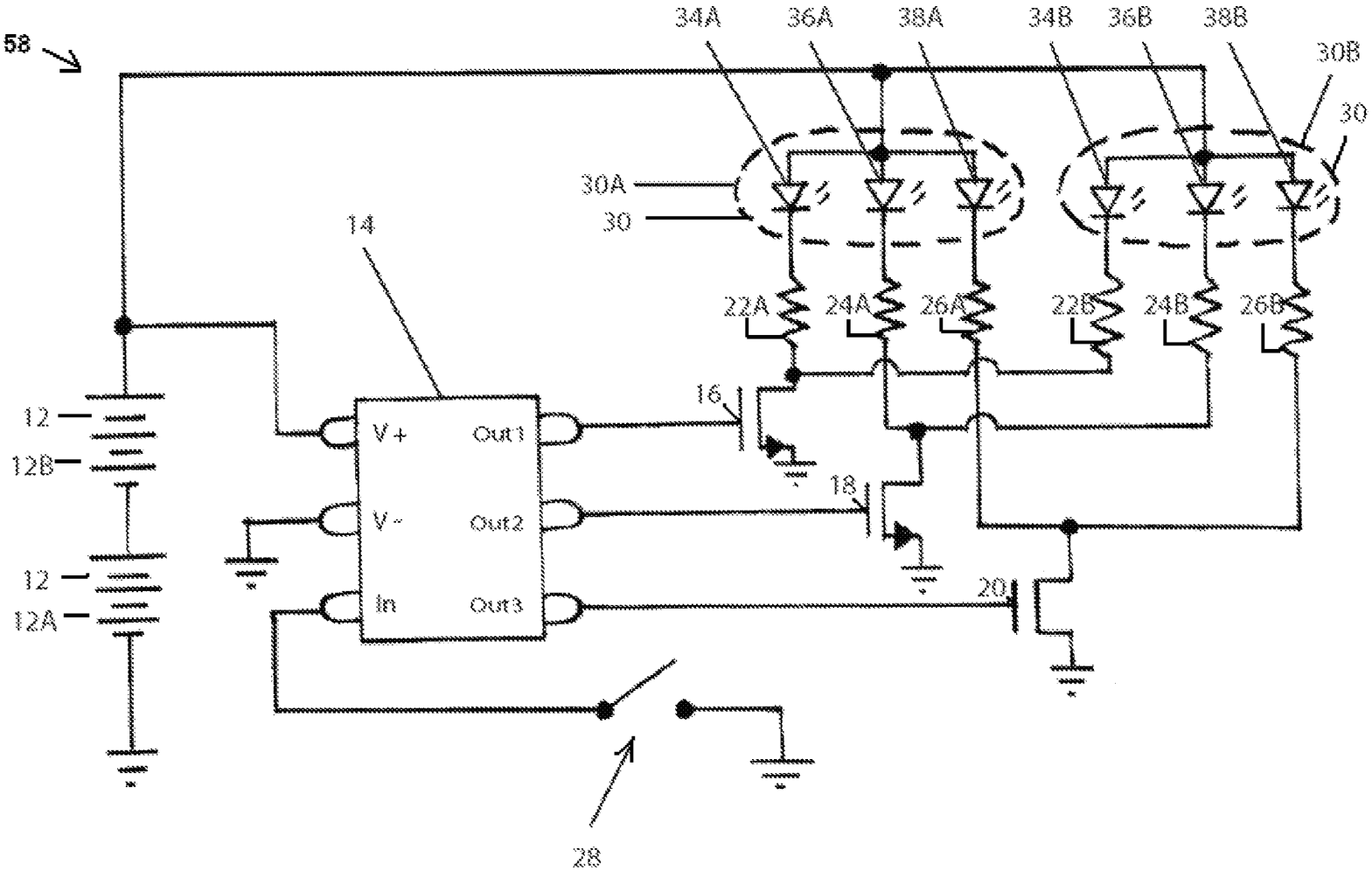
FIG. 5 is a schematic diagram of the electronic assembly of the die of FIG. 1.

FIG. 5 shows a schematic block diagram of the electronic circuitry of the die 100. As shown, microcontroller 14, which is preferably a low-power integrated circuit, controls the on/off state of three transistor switches 16, 18, 20, which in turn control the color, intensity and flash pattern of two light sources 30, illustrated as RGB light emitting diodes (LED) 30A, 30B in FIGS. 1 and 5. Each RGB LED 30A, 30B is a single integrated circuit, packaged in a clear housing and including one constituent red LED 23A or 23B, one constituent green LED 24A or 24B, and one constituent blue LED 25A or 25B, which can each be activated in various combinations and light intensities to achieve almost any color in the visible spectrum at any desired light emission intensity and in association with any desired flashing pattern. A first transistor switch 16 selectively activates both constituent red LEDs 34A and 34B; second transistor switch 18 selectively activates both constituent green LEDs 36A and 36B; and third transistor switch 20 selectively activates both constituent blue LEDs 38A and 38B. By manipulating each transistor switch, microcontroller 14 controls what color and intensity is produced by RGB LEDs 30A and 30B. Resistor elements 22A, 22B, 24A, 24B, 26A and 26B limit the on-state current circulated through respective constituent red, green and blue LEDs 32A 32B 34A 34B 36A and 36B to acceptable levels.

This electrical circuit is powered by one or more energy sources 12 mounted to printed circuit board 30. Preferably, as shown in FIG. 5, two energy sources 12, configured as two lightweight batteries 12A and 12B, are connected in series. For the circuit to function properly, the combined voltage of the batteries 12A, 12B must exceed the minimum voltage for light source 30, namely combined RGB LEDs 30A, 30B, which is preferably at least about 3.5V, but must not exceed the maximum rated voltage for microcontroller 14, which is preferably about 6.5V or less. Therefore a combination of batteries 12A, 12B preferably provides about 3.5V to about 6.5V; more preferably, about 4.5V to about 6V. In one embodiment, energy source 12 may be two 3V coin cell batteries, connected in series, that supply about 6V to electrical assembly 58. Furthermore, to avoid the low switching speeds and wasted power associated with conventional bipolar transistors, transistors 16, 18, 20 are preferably MOSFET transistors. Additionally, resistors 22A, 22B, 24A, 24B, 26A, 26B preferably operate in the range of about 10 to 100 ohms and can be selected to optimize battery life and the perceived LED brightness.

Electronic assembly 58 further includes an accelerometer 28 operatively associated with microcontroller 14. Accelerometer 28 may be any sensor capable of detecting the movement of, preferably the acceleration of, die 100. As shown in FIG. 5, accelerometer 28 is depicted as a motion detection switch connected to the input of the microcontroller 14. Upon detecting motion of die 100, accelerometer 28 forms a closed circuit with microcontroller 14, whereupon microcontroller 14 randomly changes the color displayed by light source 30. Additionally or alternatively, microcontroller 14 may randomly change the light emission intensity and/or flash pattern displayed by light source 30. The color, intensity, and/or flash pattern of light source 30 are preferably controlled by microcontroller 14 using pulse-width modulation.

In the preferred embodiment, the microcontroller 14 has an integrated timer circuit. The timer tracks the time that elapses between each detected movement of die 100 by accelerometer 28. If accelerometer 28 does not detect any motion of die 100 for a predetermined period of time long enough to indicate that the die 100 is no longer in use, microcontroller 14 is programmed to turn off light source 30 and enter into a sleep mode, minimizing power consumption to conserve energy.

Figure 6:
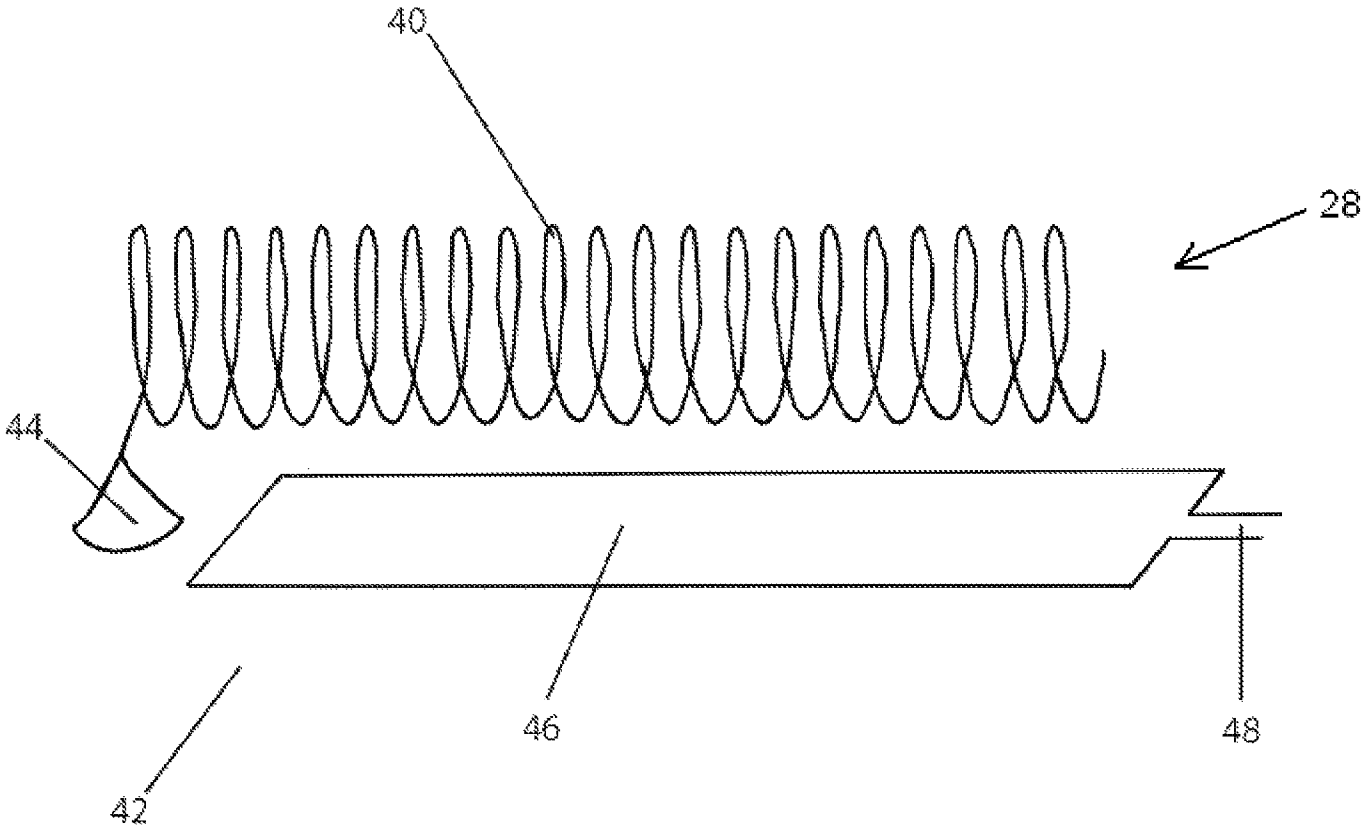
FIG. 6 is a perspective view of the accelerometer of FIG. 1.

FIG. 6 shows a detailed view of an exemplary embodiment of accelerometer 28. In this embodiment, accelerometer 28 includes a spring 40 spaced apart from and operatively associated with a contact plate 46. One end of spring 40 is attached to printed circuit board 42 via solder joint 44, forming a cantilever structure. Solder joint 44 provides a fulcrum for the movement of spring 40. Located proximate to but spaced apart from spring 40 is contact plate 46, which includes a circuit trace 48 connected to an input of microcontroller 14. Spring 40 is preferably highly flexible and positioned relative to contact plate 46 to enable highly sensitive detection of die movement. If accelerometer 28 is too sensitive, it will trigger falsely, even when little or no movement is present. In principle, to prevent activation due to the force of gravity alone, accelerometer 28 must not be triggered by accelerations of 1 G or less, since 1 G is a measure equal to the acceleration caused by the Earth's gravity. Preferably, accelerometer 28 is designed to detect only accelerations greater than 1 G, more preferably, accelerations about 3 G or more and most preferably, accelerations about 4 Gs or more. These levels of acceleration are low enough to account for any deliberate shaking or throwing of the die, but large enough to avoid false detection from any incidental movements arising from casual handling, vibrations of the table, or effects of the Earth's gravity.

FIG. 6 illustrates accelerometer 28 in a state of rest, wherein spring 40 is suspended above but does not touch contact plate 46, in such a way that there is no electrical contact between spring 40 and contact plate 46. Whereas spring 40 is electrically connected to ground voltage, contact plate 46 is connected to a microcontroller input. Upon the sudden movement of the die 100, such as the kind experienced when die 100 is rolled, tossed, thrown or shaken, spring 40 will vibrate and touch contact plate 46, making brief electrical contact. When this happens, microcontroller 14 detects the presence of the ground voltage on its input, recognizing the movement of die 100. In response each such detection of movement, the microcontroller 14 randomly selects a new state for the color, brightness, and/or flash pattern qualities displayed by light source 30, and sends the appropriate electrical signals to light source 30 to display these selected states.

In the exemplary embodiment shown in FIG. 6, spring 40 is a metal compression spring, and contact plate 42 is a rectangular metal plate having a length, width and orientation corresponding to spring 40. As shown, compression spring 40 is positioned directly above and aligned with contact plate 42 along its length, so as to increase the probability of contact between compression spring 40 and contact plate 42 upon movement of die 100. Preferably, the compression spring 40 is suspended about 1.6 mm above the contact plate 42 while at rest. In this embodiment, compression spring 40 is preferably constructed from nickel-plated steel wire having a thickness of about 0.18 mm and has a length of about 15 mm when coiled and uncompressed with about 20 coils. Additionally, compression spring 40 preferably weighs about 50 mg. Compression spring 40 has a lateral spring constant of about 0.56 N/m. and consequently is laterally displaced by about 0.4 mm for every G of acceleration it experiences. Since spring 40 is normally suspended about 1.6 mm above the contact plate 42, the die 100 must therefore experience around 4 Gs of acceleration or more to trigger accelerometer 28.

Notably, the number of times spring 40 contacts plate 42, triggering accelerometer 28, is heavily dependent upon the random movement of die 100 during each roll, and on the unpredictable nature of the vibration of spring 40. For example, firmly tapping the die with one's index finger only once may trigger accelerometer 28 some random number of times, anywhere between five and twenty-five times. Consequently, the number of times that the color, light emission intensity and/or flashing pattern is changed by microcontroller 14 in response to each triggering of accelerometer 28 during a single roll, or even during a single movement, is also random and unpredictable. Therefore, the states of the color, brightness, and/or flash pattern that are ultimately displayed by die 100 once it has come to rest after being rolled are likewise random and unpredictable.

Figure 7:
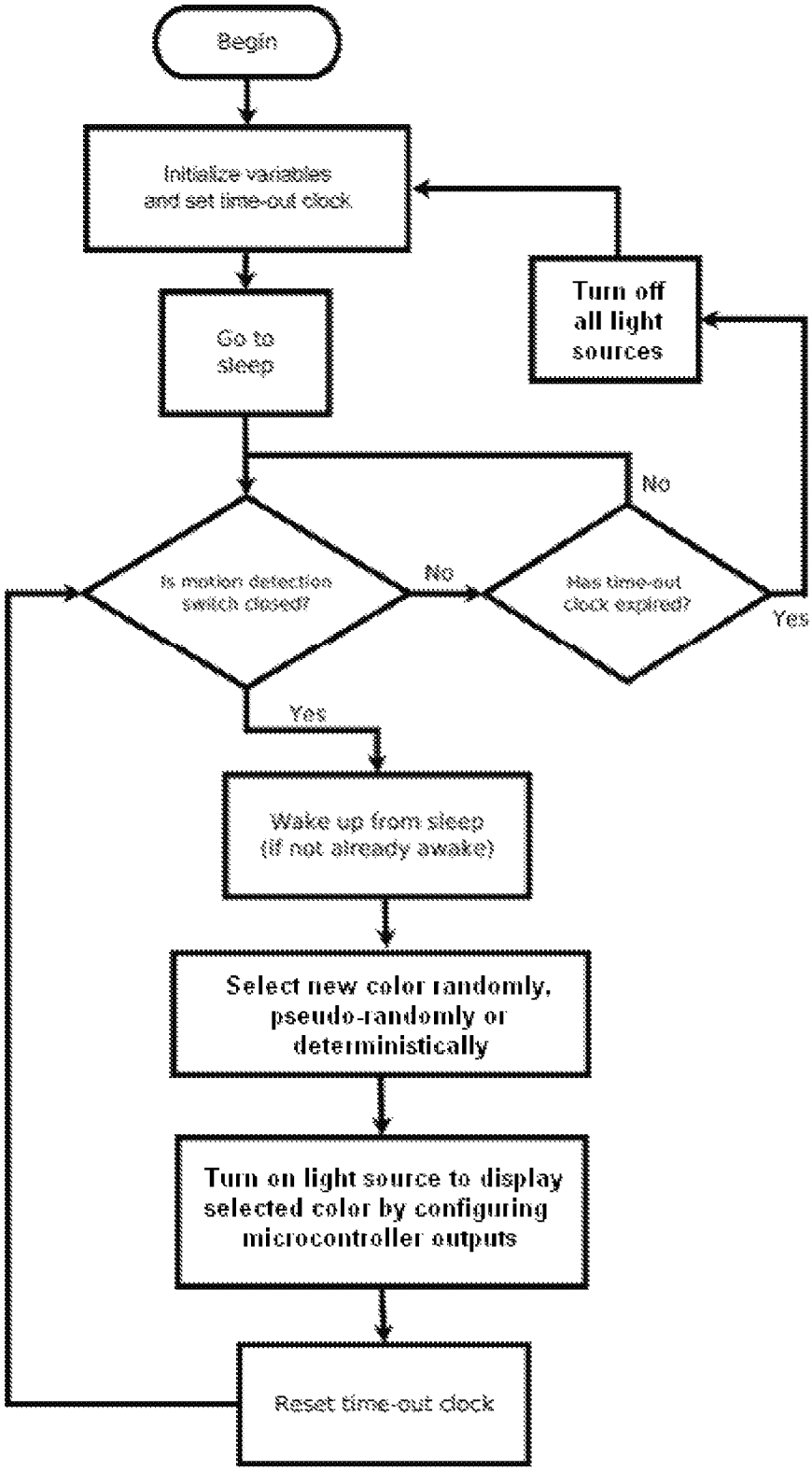
FIG. 7 is a flow-chart showing the operation of the microcontroller of FIG. 1.

FIG. 7 shows a flow chart further explaining the operation of the microcontroller 14 of an exemplary color changing die 100. Initially, microcontroller 14 waits for a signal from accelerometer 28 indicating the detection of die movement of die, such as the acceleration and/or rotation of die 100, at which point microcontroller 14 activates and sets its internal timer, performs a random calculation to select a color from a list of colors, and configures its outputs so that the chosen color is displayed by light source 30.

Every time the accelerometer 28 detects motion of the die 100, microcontroller 14 resets its internal timer and instructs light source 30 to display the next listed color. This procedure is repeated each time accelerometer 28 detects movement of die 100, specifically each time spring 40 touches contact plate 42. In the event an extended period of time elapses without detecting movement of die 100, microcontroller 14 will turn off light source 30 and enter into a sleep mode until motion is detected again. In a preferred embodiment, microcontroller 14 will turn off light source 30 and enter into a sleep mode only if no movement is detected for a continuous period of at least about 15 seconds.

There are several ways for microcontroller 14 to select a color to be displayed in response to each movement of die 100 detected by accelerometer 28. For example, microcontroller 14 might use a pseudo-random number generating algorithm (PRNG) to generate a random number between one and six, and then use the number so generated to select a color from a numbered list of six colors. Some common PRNG algorithms, suitable for this purpose, include the Linear Congruential Generator (LCG) algorithm, and the Linear Feedback Shift Register (LFSR) algorithm. Preferably, to avoid the complication of using a pseudo-random number generator, microcontroller 14 instead selects a random color by sequentially stepping through a predetermined repeating sequence of colors that has already been randomized, and which is long enough as to be unpredictable to an observer. An exemplary random sequence listing is shown in FIG. 8; while alternative methods for selecting a color to be displayed are possible, this color selection method is easy and inexpensive to implement and is substantially indistinguishable from purely random color selection, especially as the unpredictable movement of each die roll, by randomly triggering the accelerometer 28 some large and unpredictable number of times, causes the microcontroller 14 to advance through the list of colors an equally large and unpredictable number of times.

While die 100 rotates, bounces, shakes, or otherwise moves, accelerometer 28 detects its acceleration and microcontroller 14 responsively changes the color displayed by light source 30. Specifically, as die 100 moves, spring 40 vibrates, periodically making contact with contact plate 46. Each time spring 40 touches contact plate 46, microcontroller 14 changes the color displayed by light source 30. In the event that spring 40 maintains continuous contact with contact plate 46 for some finite amount of time, microcontroller 14 may cycle through more than one color change, dependent upon the contact duration. Over the course of a single roll, the color displayed by light source 30 is likely to be change a plurality of times and an unpredictable number of times. Only a relatively brief duration may elapse between each successive color change. However, once die 100 comes to rest immediately after being in motion, the color ultimately displayed by light source 30 ceases to change, and is displayed for a period of time sufficient to be observed, evaluated, and appreciated by the player. In the preferred embodiment, this final color is displayed until the die 100 is deliberately moved again by the player or until the timer elapses and the microcontroller 14 enters a low-power sleep mode. Preferably, this final color is displayed for a period of time longer than any duration a single color is displayed by light source 30 while die 100 is in motion. In one embodiment, this final color may be displayed for a period of about 15 seconds to about 2 minutes, preferably about 30 seconds. This final displayed color can be used to direct game play.

While FIG. 7 is intended to describe the operation of microcontroller 14 in a color changing die. Other dice, having the same die components, may be similarly programmed to change the light emission intensity and/or flashing pattern of light source 30 in response to the detected movement of die 100 by an accelerometer 28. In an alternative embodiment, in response to a sensor detected motion of die 100, microcontroller 14 changes not only the color, but also the light emission intensity and flash pattern displayed by light source 30 and die 100. Microcontroller 14 may use a different random number generating scheme to select the state of each of these variable qualities in response to each detected movement of die 100, so that the random outcome of each of these three variable qualities is independent and uncorrelated. For example, one pseudo-random number generator (PSRG) algorithm may be used to select the color of the illumination, while another is used to select a letter between A and F for the light source 30 to flash out repeatedly in Morse code, while a third pseudo-random number generator decides whether the illumination intensity of each flash should be dim, bright, or oscillating in brightness. This is a fanciful example, but it illustrates the flexibility of the die system to have multiple degrees of freedom.

Figure 9:
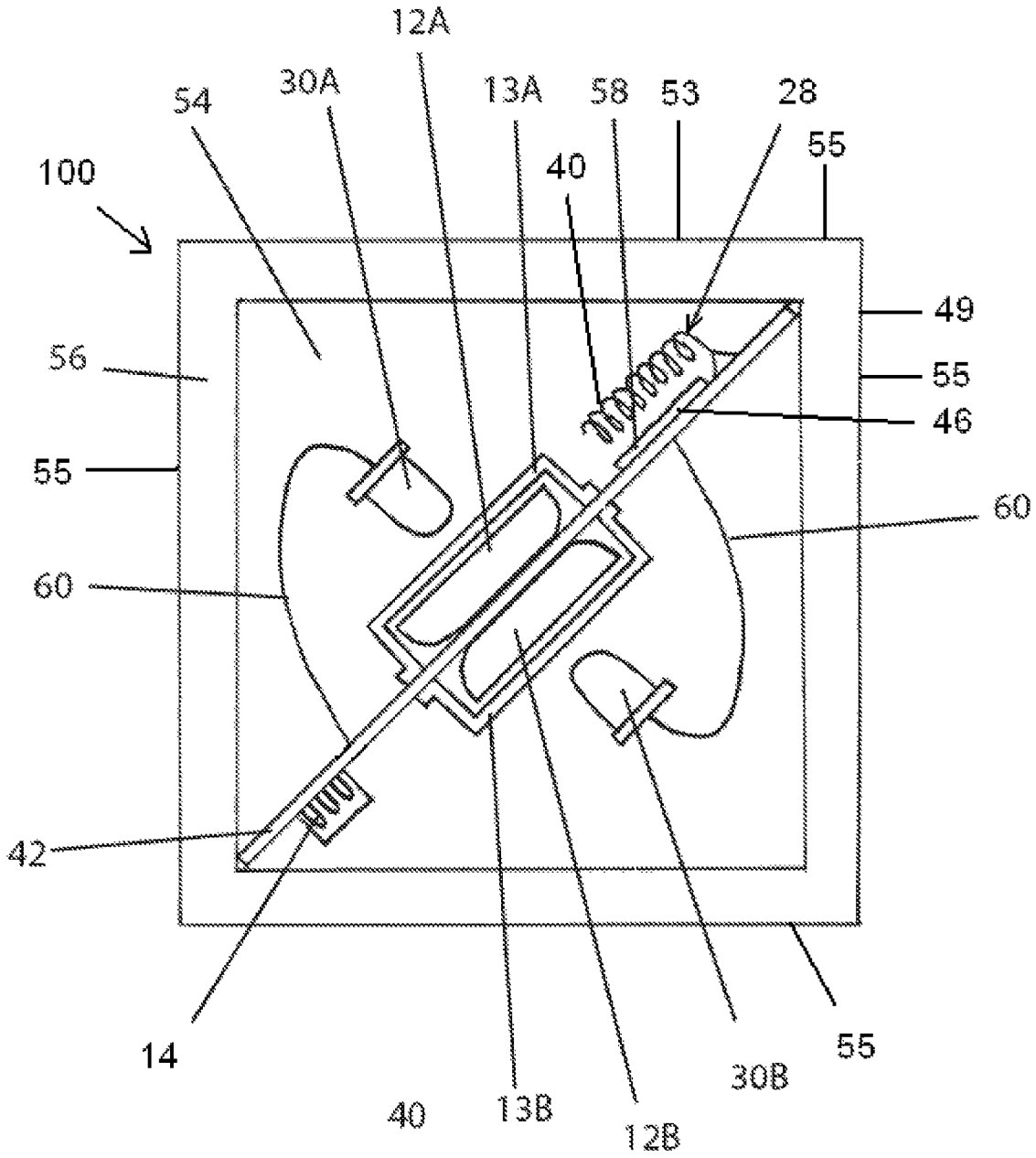
FIG. 9 is a cross-sectional top view of the die of FIG. 2(*b*).

FIG. 9 shows a cross-sectional top view of electronic assembly 58, as it is situated inside the cavity 54 of the die body 56. As shown, printed circuit board 42 is positioned along a diagonally symmetrical axis of die 100, namely a diagonal axis of die body 56 symmetrically dividing die 100 into two equal halves. Thus positioned, printed circuit board 42 enables the formation of a balanced, evenly weighted die body 56. Printed circuit board 42 is appropriately sized and positioned in such a way that it fits securely within cavity 34 along one of the diagonal planes of symmetry so that it does not move when die 100 is rolled, tossed, thrown or shaken. Additionally, printed circuit board 42 is also preferably thinly constructed, preferably having a thickness of about 0.3 mm or less, to minimize any affect on the weight distribution of die 100. The other components of electronic assembly 58 are also positioned relative to printed circuit board 42 at locations that maintain the symmetry and balance of die 100. As shown in FIG. 9, a RGB LED 30A, battery 12A and battery holder 13A are mounted to a first side of printed circuit board 42, while a second RGB LED 30B, battery 12B and battery holder 13B are mounted to an opposing side of printed circuit board 42 at corresponding locations. Microcontroller 14, transistor switches 16, 18, 20, and resistors 22A, 22B, 24A, 24B, 26A, 26B and accelerometer 28 are also arranged and position on printed circuit board 42 so as to maintain the symmetry and balance of die body 56. Die 100 is therefore preferably constructed as a balanced die having a substantially even weight distribution throughout its body 56, making it equally likely to land on any given die face 55, enabling it to be used in games of chance that require equal odds.

Moreover, by positioning two light sources 30 on opposite sides of printed circuit board 42, light is evenly distributed to and directed towards each die face 55 of die 100. If light source 30 were positioned on only one side of the printed circuit board 42, a shadow would be cast on the opposing side of die 100 by the printed circuit board 42. In the embodiment shown in FIG. 9, RGB LEDs 30A, 30B are directed away from die faces 55 and point towards the center of the die. In fact, RGB LEDs 30A, 30B are pointed towards printed circuit board 42, specifically towards a reflective surface mounted thereon, which acts as a reflector and light diffuser. To conserve space within die body 56, these reflective surfaces are simply the exterior surfaces of battery holders 13A, 13B, which operate as flat mirrored reflectors. For example, many coin cell battery holders, such as the BAT-HLD-001 from Linx Technologies, are made from stamped sheets of reflective nickel-coated steel ideal for this purpose. As coin-cell batteries themselves are also made of nickel-plated steel, wherever they are unconcealed by battery holders these batteries also act as flat mirror reflectors. Rigid wire leads 60, attached to printed circuit board 42 via solder joints, are used to fixedly position and suspend the RGB LEDs 30A, 30B in place. Wire leads 60 preferably have a length up to about one inch long, and are made of sturdy copper wire, which provides the structural support to rigidly hold RGB LEDs 30A, 30B in position but which can be bent by hand or with pliers to adjust LEDs positioning during manufacturing. Such leads come pre-attached on many commercially available RGB LEDs. Preferably, RGB LEDs 30*a* and 30*b* are arranged so as to be substantially perpendicular to the surface of the battery holders/reflectors and to printed circuit board 42 in general. This orientation creates the most even distribution of direct and reflected light across die faces 55. In an exemplary embodiment, light source 30 is pointed towards a reflective surface of or mounted on printed circuit board 42, wherein the angle formed between the reflective surface and light source 30 is about 60°__ to about 120°, more preferably, about 80° to about 100°, and most preferably, at about 90°.

To further enhance light diffusion, printed circuit board 42 is preferably made from industry standard FR4 epoxy material. Since this material is translucent and fairly colorless, it does not cast shadows so as to substantially affect the perceived distribution or quality of light. If masking is to be used on printed circuit board 42, the masking is preferably white or silver in order to reflect the light emitted from light source 30 instead of absorbing it.

The aforementioned embodiments of the invention have been directed to a die including at least two variable qualities for producing a random outcome that conveys information for directing game play. It is also envisioned, however, that die 100 may also be configured as a die having only one or one or more variable qualities. In particular, die 100 may be a color changing die having a die body 56 and the same electronic components as the various embodiments of die 100 described above. For example, die 100 may have a power source 12, a light source 30, a microcontroller 14 and an accelerometer 28 which are all operatively associated to change the color of the die in response to every detected acceleration of the die detected by the accelerometer. In this embodiment, however, die 100 need not have indexed faces for distinguishing the orientation of die 100; each face 55 of die body 56 may be the same and include no distinctive indicia.

The present invention is also directed to a method for using die 100 of the present invention to direct game play. The method involves rolling, throwing, tossing, shaking or otherwise moving die 100, wherein at least two different variable qualities of die 100 randomly and independently change states in response to the movement of die 100, yielding two independent random outcomes upon each roll of the die. Specifically, die faces 55 are repositioned as die 100 is rolled. The displayed uppermost face 53 of die 100 therefore changes depending upon how die 100 lands after rolling. The orientation of indexed die faces 55, particularly the resultant uppermost indexed die face 53, constitutes a first variable quality conveyed by die 100. Moreover, the color, light emission intensity, flashing pattern or combinations thereof of light source 30 changes in response to the detected acceleration of die 100 by accelerometer 28. The resultant color displayed by light source 30 establishes a second variable quality. The intensity of light emitted by light source 30 may establish an additional variable quality, and the flashing pattern of light source 30 may establish yet another variable quality. Each of these variable qualities is independently randomized during each roll of die 100, so that each variable quality conveys information to the player that is not conveyed by any of the other variable qualities. These random changes in the color, intensity and/or flashing pattern of light source 30 in response to detected acceleration of die 100 are visible on at least a portion of the die, such as on one or more die faces 55. Preferably, these changes are visible throughout die body 56, in such a way that the entire die 100 appears to change colors, change light emission intensities and change light flashing patterns as die 100 is in motion. When die 100 settles, the color, light emission intensity, flashing pattern or combination thereof generated by microcontroller 14 in response to a last detected motion of die 100 before coming rest is sustained by light source 30 for a period of time long enough to be distinguished and appreciated by an observer.

The resultant random outcomes resulting from the random processes that act upon the variable qualities of the die 100 during a roll, namely the indicia 66 shown on the uppermost face 53 of die 100 as well as the color, light emission intensity, flashing pattern or combinations thereof displayed by light source 30 once die 100 comes to rest may be used to direct game play. For example, indicia 66, a displayed color, a displayed light intensity, a displayed light flashing pattern or combinations thereof dictate the number of positions a game piece is moved on a game board. For example, a board game may be devised wherein the color of die 100 is used to select amongst several color-coded playing pieces, while its flashing pattern flashes quickly or slowly to dictate the speed of the action to be performed on that piece, while its brightness is strong or weak to indicate the strength of the action in the context of the game. Meanwhile, the numbered indicia 66 on the die's uppermost face 53 simultaneously dictates how many times that action is to be performed. With each roll of the die 100, the variable qualities of die 100 are independently randomized, creating an interesting and unpredictable playing experience. In another embodiment, die 100 may be used in a game of chance wherein players place a wager on an indicia, color, light intensity, light flashing pattern or combinations thereof displayed by die 100.

Figures 10, 11:
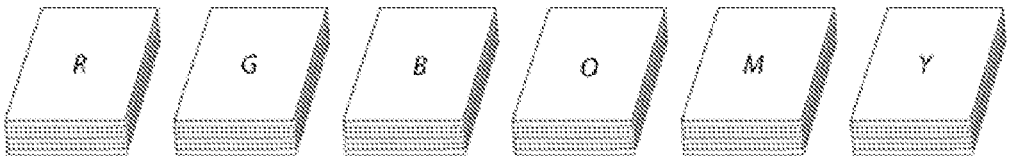
FIG. 10 is a game board identifying the permitted movement of a game piece when 4 is displayed on the upper most die face and when the die glows blue after rolling.
FIG. 11 shows a plurality of card decks of different colors corresponding to the colors capable of being displayed by the die.

In an exemplary embodiment, die 100 is used in conjunction with the game board shown in FIG. 10. The game board has a rectilinear grid, typical of board games. Each square of the game board is labeled with one of six different colors: B for blue, R for red, G for green, Y for yellow, M for magenta, and W for white. FIG. 10 further illustrates a particular method by which a color changing die 100 with indicia 66 numbered one through six displayed on each die face 55 can be used to direct the movement of a game piece on the game board. The method involves rolling the die and observing the numbered indicia on the upper most die face 53 as well as the illumination color of die 100 upon landing and coming to a state of rest. In this game, a player can then move his piece to any square he wishes, so long as it satisfies two criteria: firstly, the square must be no further away from the game piece's original position than the number indicated on the uppermost die face; and secondly, the color of the square must match the color displayed by the die after rolling. For example, in the scenario illustrated in FIG. 10, upon rolling, die 100 has landed with the number four shown on uppermost face 53, and the die has turned a blue color. The appropriate squares to which the game piece can be moved to are indicated in FIG. 11 with cross-hatching.

FIG. 11 illustrates another game wherein die 100 can be used to direct card selection in a card game. Specifically, the color changing die 100 having faces 55 numbered one through six directs selection of cards from one of several colored card decks. Each card deck is labeled with a different color: B for blue, R for red, G for green, Y for yellow, M for magenta and W for white. After die 100 is rolled, the numerical indicia displayed on an uppermost die face 53 designates the number of cards to be drawn by a player, while the resultant color of die 100 after it is rolled dictates from which deck the cards are to be drawn.

The present invention provides a number of advantages over conventional dice of the prior art. Die 100 is designed to enhance game play by increasing the unpredictability of the states of the variable qualities displayed by die 100 after rolling. As discussed above, die 100 embodies at least two variable qualities that randomly change in response to the roll of die 100, thereby producing random outcomes with each roll of die 100. Preferably, die 100 includes at least a color changing mechanism for changing the color of a portion of or the entirety of die 100 and distinct indicia 66 displayed on die faces 55. In this embodiment, die 100 therefore displays both a random indicia 66 and glows a random color with each toss of die 100. The many unique combinations of die colors and indicia achieved by die 100 may therefore be used to enhance game play. For example, the resulting color and indicia produced by die 100 can be used to direct the movement of a game piece, direct the drawing of one or more cards, select amongst several game pieces, or dictate other actions involved in a game of chance. Die 100 may further include the display of additional variable qualities conveyed by light source 30, such as the brightness and/or flashing pattern, that change with the roll of die 100, thereby further increasing the unpredictability and complexity of the result of die 100 when rolled. Die 100 also includes a number of design features that enhances its attractiveness and renders it suitable for use in games of chance. For example, light source 30 is positioned to evenly distribute and diffuse light throughout die body 56, so that die 100 appears to glow uniformly when illuminated. Additionally, the uniform weight distribution of die body 56 ensures that no side of die 100 is unevenly biased, enabling die 100 to be used in games of chance requiring even odds. Furthermore, the simplicity of its design enables die 100 to be easily manufactured and affordably mass produced.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. It is to be understood that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed. The invention should therefore not be limited by the above described embodiment, method, and examples.

What is claimed is:

1. A die for use in game play, wherein the die comprises at least two variable qualities for conveying information for use in game play, wherein each of the at least two variable qualities is capable of randomly changing states independently of one another in response to rolling of the die such that each variable quality produces a random outcome, wherein a first of the at least two variable qualities is a color of the die and wherein the color of the die randomly changes in response to the rolling of the die; and wherein the die further comprises:

a power source;

a light source for changing the color of the die;

a microcontroller operatively associated with said light source; and an accelerometer operatively associated with said microcontroller;

wherein the color displayed by the light source is changed by the microcontroller in response to acceleration of the die detected by the accelerometer.

2. The die of claim 1, wherein the changes in the color of the die in response to the acceleration of the die detected by the accelerometer is visible on at least an exterior surface of the die.

3. The die of claim 2, wherein one of the colors displayed by the light source, in response to a last detected acceleration of the die before the die comes to rest, is displayed for a period of time longer than a duration a single color is displayed by the light source when the die is rolling.

4. The die of claim 2, wherein the die further comprises a plurality of faces comprising distinct indicia and wherein a second of said at least two variable qualities is the orientation of the die.

5. The die of claim 2, wherein the microcontroller is programmed to turn off the light source if acceleration of the die is not detected for a predetermined period of time.

6. The die of claim 2, wherein the light source comprises an LED, wherein a lens of the LED is pointed towards an internal region of the die and faces a reflective surface to diffuse light within the die and wherein the LED lens is substantially perpendicular to the reflective surface.

7. The die of claim 2, wherein the die has a transparent or translucent body forming a shell and wherein the die further comprises a mask operatively associated with the body for forming the indicia.

8. The die of claim 2, wherein the die further comprises a printed circuit board and wherein the accelerometer comprises a spring soldered to the printed circuit board at one end and wherein an opposite end of the spring is suspended in proximity to and spaced apart from an electrical contact.

9. The die of claim 6, wherein the light source comprises two LEDs and wherein the die further comprises a printed circuit board positioned diagonally within the die and wherein the two LEDs are positioned on opposite sides of the printed circuit board and wherein each of the two LEDs faces a reflective surface mounted to each side of the printed circuit board.

10. The die of claim 4, wherein the die further comprises a third variable quality capable of randomly changing states independently of the first and second variable qualities in response to the rolling of the die.

11. The die of claim 10, wherein the third variable quality is selected from the group consisting of a brightness and flashing pattern emitted by the light source, wherein the third variable quality changes in response to the acceleration of the die detected by the accelerometer and wherein the change in the third variable quality is visible on at least an exterior surface of the die.

12. The die of claim 4, wherein components of the die are arranged to form a balanced die having a substantially even weight distribution throughout the body of the die.

13. A die for use in game play, wherein the die comprises:

a power source;

a light source for changing the color of the die;

a microcontroller operatively associated with said light source; and an accelerometer operatively associated with said microcontroller;

wherein the color displayed by the light source changes in response to every acceleration of the die detected by the accelerometer and wherein the color displayed by the die conveys information for use in game play; and wherein the light source comprises two LEDs and wherein the die further comprises a printed circuit board positioned diagonally within the die and wherein the two LEDs are positioned on opposite sides of the printed circuit board and wherein each of the two LEDs faces a reflective surface mounted to each side of the printed circuit board.

14. The die of claim 13, wherein components of the die are arranged to form a balanced die having a substantially even weight distribution throughout the body of the die.

* * * * *